United States Patent [19]

Pietsch

[11] 4,400,033

[45] Aug. 23, 1983

[54] SEAT WITH A BACK REST AND ARM REST

[75] Inventor: Helge Pietsch, Detmold-Lobbruch, Fed. Rep. of Germany

[73] Assignee: Gebr. Isringhausen, Lemgo, Fed. Rep. of Germany

[21] Appl. No.: 190,928

[22] Filed: Sep. 26, 1980

[30] Foreign Application Priority Data

Sep. 24, 1979 [DE] Fed. Rep. of Germany ... 7927079[U]

[51] Int. Cl.[3] ..... A47C 7/54

[52] U.S. Cl. ..... 297/417; 297/115

[58] Field of Search ..... 297/417, 115, 113, 162, 297/411

[56] References Cited

U.S. PATENT DOCUMENTS

| | | | |
|---|---|---|---|
| 3,261,641 | 7/1966 | Black et al. | 297/162 |
| 3,374,032 | 3/1968 | Del Giudice | 297/417 |
| 3,544,163 | 12/1970 | Krein | 297/417 |
| 3,563,604 | 2/1971 | Barecki | 297/113 |

FOREIGN PATENT DOCUMENTS

| | | | |
|---|---|---|---|
| 1252363 | 10/1967 | Fed. Rep. of Germany | 297/417 |
| 284491 | 2/1928 | United Kingdom | 297/113 |

*Primary Examiner*—Francis K. Zugel

*Attorney, Agent, or Firm*—Salter & Michaelson

[57] ABSTRACT

A seat has a back rest 2 and an arm rest 12 the inclination of the arm rest being adjustable and the arm rest being movable from an in use position to an out of use raised position.

In order to prevent the position of the arm rest being changed when the back rest inclination is changed the arm rest is attached to the seat by a parallelogram linkage. Of the four shafts of the linkage one 5 is the pivotal connection of the back rest to the seat frame, one 7 is the pivotal connection of the arm rest to the back rest, one 23 is at one end of a tie rod 13 by which the tie rod connects to the seat frame, and the last shaft is a spindle 14 connected to the other end of the tie rod.

In its position of use the arm rest is releasably attached to the spindle and is released from the spindle when moved to the out of use position.

The spindle is guided along an arcuate slot 20 in a plate 8 attached to the arm rest and pivotable about the arm rest pivot.

2 Claims, 1 Drawing Figure

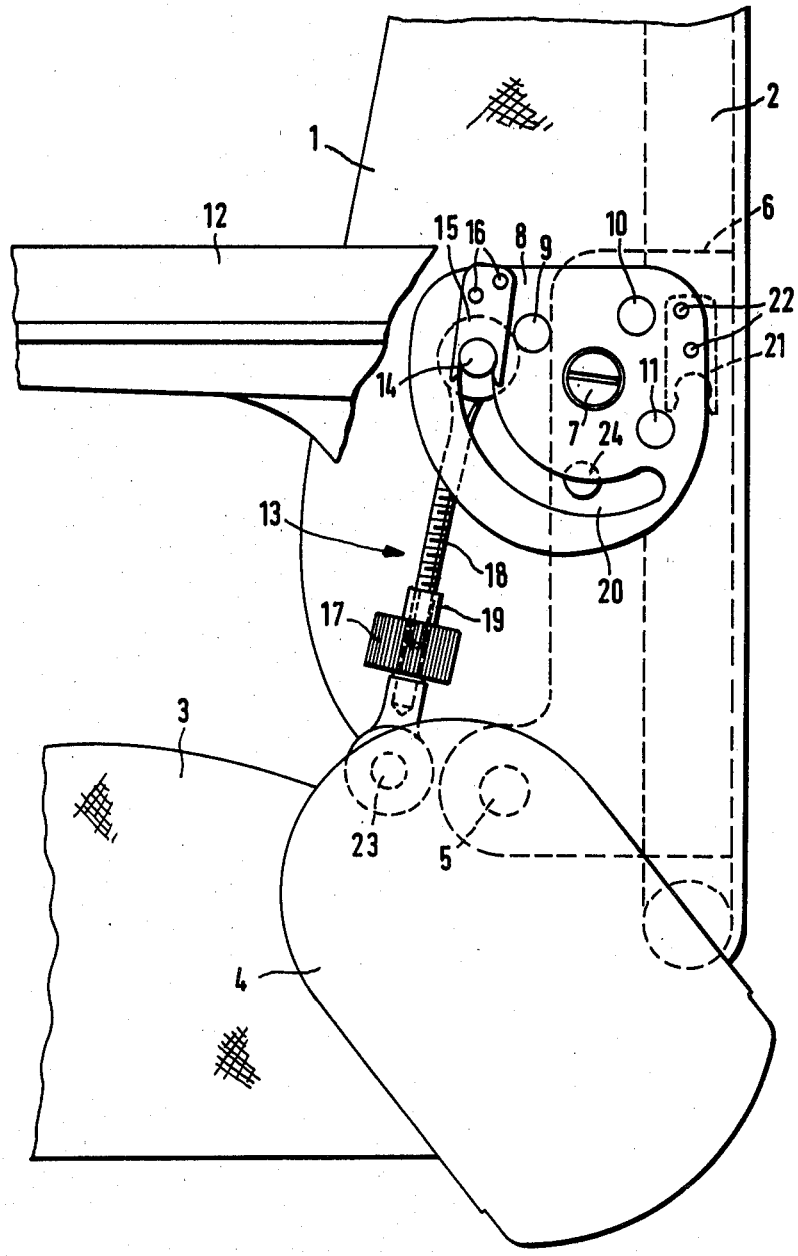
1
2
12
15
16
8
9
10
6
22
21
14
11
7
24
13
18
20
17
19
3
23
5
4

SEAT WITH A BACK REST AND ARM REST

This invention relates to seats with back rests and arm rests.

Seats with arm rests which may be turned upwards are required in vehicles and in auditoriums or similar buildings in which the space available in front of the seat for people to pass along the seats is restricted.

It is known to attach arm rests to seats either to the back rest or to the seat frame and the present invention is concerned with seats in which the arm rest is pivotally mounted on the back rest. With back rests whose inclination can be adjusted there is a problem in that the arm rest will also change its inclination when the back rest inclination is changed. As a result the occupant assumes an uncomfortable attitude in the seat.

It is an object of the invention to provide a seat which overcomes this disadvantage with a construction which is simple and uses little space.

According to the invention a seat comprises a back rest, at least one arm rest, a seat frame, a pivotal attachment between the back rest and the seat frame about which the inclination of the back rest is adjustable, a pivotal attachment between the arm rest and the back rest about which the arm rest is pivotable upwards to be moved from a position of use to an out of use position in which the arm rest is in the plane of the back rest, the attachment of the arm rest comprising a parallelogram linkage having four shafts; a shaft constituted by the pivotal attachment of the back rest to the seat frame, a shaft constituted by the pivotal attachment of the arm rest to the back rest, a shaft by which a tie rod is pivotally connected at one end to the seat frame and a spindle carried by the other end of the tie rod, the arm rest in its position of use engaging the spindle and being releasably attached thereto.

Preferably the spindle is guided for movement along an arcuate slot formed in a pivotable plate mounted about the pivotal attachment of the arm rest to the back rest and the arm rest being attached to the pivotable plate. The pivotable plate forms part of the parallelogram linkage and the spindle is guided in the slot in such a way that the tie rod cannot move in an uncontrolled manner when the arm rest is in its out of use or rest position. The slot also provides an end stop during pivoting of the arm rest.

Conveniently in the out of use position the arm rest is supported releasably by clamping means which is engageable with means carried on the back rest. In the out of use position the arm rest is in the same plane as that of the back rest and is moved whenever the back rest inclination is changed. However when the arm rest is moved to a position of use the arm rest is attached to the spindle so that it is supported independently of the inclination of the back rest and remains permanently in the selected position of use even when the back rest is inclined considerably to the rear.

Preferably the tie rod is telescopically adjustable. This allows the position of the arm rest relative to the back rest to be adjusted to suit the occupant of the seat by effectively lengthening or shortening the tie rod.

Further features of the invention will appear from the following description of an embodiment of the invention given by way of example only and with reference to the drawing which is a side elevation of a seat.

In the drawing a seat has a back rest 1 and a back rest frame 2. A seat frame (not shown) carries a seat cushion

3 and a bracket 4 rigidly attached to the seat frame. A pivot shaft 5 is mounted on the bracket 4 and to a side plate 6 welded to the back rest frame 2 and serves as a pivot for the back rest.

A plate 8 is pivotally mounted on the side plate 6 by means of a shaft 7. The plate 8 is rigidly secured to an arm rest 12 at one side of the seat by bolts 9, 10 and 11. Thus the arm rest in pivoting about the shaft 7 moves with the plate 8.

A tie rod 3 is pivotally mounted at one end on the bracket 4 by a shaft 23 and at the other end of the tie rod 13 is carried a spindle 14. The spindle 14 is releasably connected to the plate 8 by a clip fastener 15 which is attached to the plate 8 by rivets 16. Thus apart from its releasable connection to the plate 8 the spindle is not directly attached to other parts.

An arcuate slot 20 is formed in the plate 8 and the spindle 14 is located in the slot for movement therealong in placing the arm rest in an out of use position as will be described. Thus the slot 20 determines the extent of movement of the spindle 14.

So long as the spindle 14 is retained by the fastener 15 the arm rest 12 is in the illustrated position for use by the occupant which is independent of the inclination of the back rest 2. If it is desired to adjust the inclination of the arm rest when in use the length of the tie rod 13 can be changed. This is achieved by rotating a knurled nut 17 so that two elements 18 and 19 of the rod are telescopically moved relative to one another.

If the arm rest 12 is to be moved from the illustrated in use position to an out of use position in which it lies generally in the plane of the back rest 2 the free end of the arm rest 12 is pulled upwards with a light force sufficient to disengage the fastener 15 from the spindle 14 so that the arm rest pivots upwards about shaft 17 and the spindle 14 passes along the slot 20 as the plate 8 moves with the arm 12 about the shaft 17.

At the end of the upward movement of the arm rest 12 the spindle reaches the end of the slot which acts as a stop and at the same time a bolt 24 carried on the plate 6 engages with a clip fastener 21 attached to the plate 8 by means of two rivets 22. The arm rest is thereby held in the raised out of use position relative to the back rest and it follows any alteration in inclination of the back rest and does not hinder the occupant of the seat.

In the illustrated in use position the arm remains in the selected position irrespective of the inclination adopted by the back rest by movement of the back rest about the shaft 5 due to the shafts 5 and 23 being in fixed positions in relation to the back rest and due to the parallelogram linkage formed by the shafts 5 and 23 and the spindle 14 and shaft 17 causing the plate 8 to pivot about the shaft 17 during alteration of the back rest inclination.

In the illustrated embodiment the simplicity and small space requirement of the construction can be appreciated. In the direction of the shaft 7 only two thicknesses of material are required, the thickness of the plate 8 and the thickness of the upper end of the tie rod 13. Thus the fittings to the back rest are flat and occupy little widthwise space and can, if desired, be covered by the back rest cover. This construction arises in part from the functions of the plate 8 as a component of the parallelogram linkage for guiding the arm rest, to provide an end stop for the movement of the arm rest and to provide guides for the tie rod 13.

What I claim as my invention and desire to secure by Letters Patent of the United States is:

1. A seat comprising a back rest, at least one arm rest, a seat frame, a pivotal attachment between the back rest and the seat frame about which the inclination of the back rest is adjustable, a pivotal attachment between the arm rest and the back rest about which the arm rest is pivotable upwards for movement from a position of use to an out of use position in which the arm rest is in the plane of the back rest, the pivotal attachment of the arm rest comprising a parallelogram linkage having four shafts, including a shaft that pivotally connects the back rest to the seat frame, a shaft that pivotally attaches the arm rest to the back rest, a shaft for pivotally connecting a tie rod at one end thereof to the seat frame, and a spindle carried by the other end of the tie rod, the arm rest in its position of use engaging the spindle and said arm rest having a fastener joined thereto which is releasably attached to said spindle for normally fixing said arm rest in the down position relative to said back rest, a pivotable plate also joined to said arm rest and having an arcuate slot formed therein, the spindle being guided for movement within said arcuate slot, said plate being mounted about the pivotal attachment of the arm rest to the back rest and being movable with said arm rest, said slot in which said spindle is received limiting the movement of said arm rest relative to said back rest, and clamping means joined to said plate and engageable with said back rest for releasably supporting the arm rest in the out of use position.

2. A seat as claimed in claim 1, said tie rod being telescopically adjustable to adjust the inclination of the arm rest relative to said seat.

* * * * *